US010363676B2

(12) United States Patent
Bagley

(10) Patent No.: US 10,363,676 B2
(45) Date of Patent: Jul. 30, 2019

(54) MANDOLINE WITH SPIRALIZER INSERT

(71) Applicant: Progressive International Corporation, Kent, WA (US)

(72) Inventor: Justin Bagley, Seattle, WA (US)

(73) Assignee: Progressive International Corporation, Kent, WA (US)

( * ) Notice: Subject to any disclaimer, the term of this patent is extended or adjusted under 35 U.S.C. 154(b) by 0 days.

(21) Appl. No.: 15/923,332

(22) Filed: Mar. 16, 2018

(65) Prior Publication Data

US 2018/0264674 A1 Sep. 20, 2018

Related U.S. Application Data

(60) Provisional application No. 62/472,454, filed on Mar. 16, 2017.

(51) Int. Cl.

| | |
|---|---|
| ***B26D 3/11*** | (2006.01) |
| ***B26D 3/28*** | (2006.01) |
| *B26D 7/06* | (2006.01) |

(52) U.S. Cl.

CPC ..... *B26D 3/283* (2013.01); *B26D 3/11* (2013.01); *B26D 7/0666* (2013.01); *B26D 2003/286* (2013.01); *B26D 2003/288* (2013.01); *B26D 2210/02* (2013.01)

(58) Field of Classification Search

CPC .... B26D 3/283; B26D 3/11; B26D 2003/286; B26D 2003/288; B26D 7/0666; B26D 2210/02

See application file for complete search history.

(56) References Cited

U.S. PATENT DOCUMENTS

| | | | | |
|---|---|---|---|---|
| 5,216,031 | A | 6/1993 | Dobson et al. | |
| 5,765,472 | A * | 6/1998 | Kim | B26D 3/283 83/167 |
| 6,082,645 | A * | 7/2000 | Himmighofen | B26D 3/283 241/168 |
| 6,401,605 | B1 * | 6/2002 | Repac | A47J 19/06 83/437.2 |
| 7,066,071 | B2 | 6/2006 | Zeder et al. | |
| 8,181,560 | B2 * | 5/2012 | Hauser | B26D 3/283 30/283 |
| 8,438,961 | B2 * | 5/2013 | Repac | B26D 3/283 83/440.2 |
| 9,682,490 | B2 * | 6/2017 | Stewart | B26D 7/2628 |
| 9,821,483 | B2 * | 11/2017 | Colburn | B26D 3/283 |
| 10,160,133 | B2 * | 12/2018 | Hauser | B26D 7/2628 |
| 2002/0174754 | A1 * | 11/2002 | Vincent | A47J 43/25 83/247 |

(Continued)

FOREIGN PATENT DOCUMENTS

FR 2861629 A1 5/2005

*Primary Examiner* — Sean M Michalski

(74) *Attorney, Agent, or Firm* — Lowe Graham Jones PLLC

(57) ABSTRACT

A mandoline slicer includes a slicing ramp with a rearward and forward portion defining an opening. A main slicing blade is mounted to the forward slicing portion. A spiral slicing insert is configured to fit within the opening, and includes a circular support, a spindle, and a spiral slicing blade positioned inside the circular support. In some versions, the insert is invertible, having a second spiral slicing feature on a lower side.

15 Claims, 6 Drawing Sheets

(56) References Cited

U.S. PATENT DOCUMENTS

2004/0200366 A1* 10/2004 Koerselman ..... B26D 3/283 99/537
2004/0231482 A1* 11/2004 Boilen ..... B26D 3/283 83/425.3
2005/0028685 A1* 2/2005 Yamamoto ..... A47J 43/25 99/537
2006/0075872 A1* 4/2006 Wangler ..... B26D 3/283 83/856
2006/0081108 A1* 4/2006 de Buyer ..... B26D 3/283 83/703
2006/0283299 A1* 12/2006 Mellen ..... B26D 3/283 83/401
2007/0062349 A1* 3/2007 Ishii ..... B26D 3/283 83/13
2007/0089577 A1* 4/2007 Wong ..... B26D 3/283 83/13
2007/0125207 A1* 6/2007 Lucas ..... B26D 3/283 83/13
2007/0144326 A1 6/2007 De
2009/0133587 A1 5/2009 De
2009/0255391 A1 10/2009 Hood et al.
2010/0199823 A1* 8/2010 Dalla Piazza ..... B26D 3/283 83/437.2
2011/0067545 A1* 3/2011 Robbins ..... B26D 3/283 83/698.71
2011/0094111 A1 4/2011 Hauser et al.
2011/0132161 A1* 6/2011 Robbins ..... B26D 3/283 83/13
2012/0090480 A1* 4/2012 Caspar ..... B26D 3/11 99/537
2012/0198980 A1* 8/2012 Bagley ..... B26D 3/283 83/699.51
2012/0227564 A1* 9/2012 Fung ..... A47J 43/25 83/856
2016/0193744 A1* 7/2016 Patel ..... B26D 3/26 83/167
2016/0250768 A1* 9/2016 Levine ..... B26D 3/11 83/52
2017/0136644 A1* 5/2017 Bagley ..... B26D 1/03
2018/0043564 A1* 2/2018 Zakowski ..... A47J 43/0722
2018/0169883 A1* 6/2018 Repac ..... B26D 3/11
2018/0220828 A1* 8/2018 Conti ..... A47J 43/04
2018/0264671 A1* 9/2018 Bagley ..... B26D 3/11
2018/0353014 A1* 12/2018 Antkowiak ..... A47J 43/0722
2019/0014948 A1* 1/2019 Cheung ..... A47J 43/0722

* cited by examiner

MANDOLINE WITH SPIRALIZER INSERT

PRIORITY CLAIM

This application claims the benefit of U.S. provisional application No. 62/472,454, filed Mar. 16, 2017, the contents of which are incorporated by reference.

FIELD OF THE INVENTION

The present invention relates to mandoline slicers.

BACKGROUND OF THE INVENTION

Mandoline-type slicers have been used for many years, but they have typically been limited in the way they can perform slicing operations. Though all can slice food in some fashion, they do not operate to make spiral cuts, and they can be complicated to reconfigure from one cutting type to another.

SUMMARY OF THE INVENTION

A mandoline slicer, in accordance with a preferred version, includes a frame having a pair of opposing frame sidewalls. A slicing ramp having a rearward ramp portion is positioned between the opposing frame sidewalls and a forward ramp portion is positioned between the opposing frame sidewalls, the forward ramp portion having a main slicing blade with a sharp edge facing toward the rearward ramp portion, the rearward ramp portion being spaced apart from the forward ramp portion to define an opening between the rearward ramp opening and the forward ramp opening.

A spiral slicing insert is removably seated within the opening, the spiral slicing insert having an upper side and a lower side. The upper side of the spiral slicing insert has an upper circular support, an upwardly extending spindle, and a first spiral slicing blade positioned inside the upper circular support In one version, the lower side of the spiral slicing insert also has a lower circular support, a downwardly extending spindle, and a second spiral slicing blade positioned inside the upper circular support. In such a version, the spiral slicing insert is invertible so that it is selectively positionable within the opening such that either the upper side of the spiral slicing insert extends upwardly away from the slicing ramp or the lower side of the spiral slicing insert extends upwardly away from the slicing ramp.

In some versions, the spiral slicing insert further comprises a first blade guard extending upwardly along a first edge of the spiral slicing insert, the first blade guard abutting the main slicing blade when the spiral slicing insert is positioned within the opening with the upper side of the spiral slicing insert extending upwardly.

In some examples, the spiral slicing insert further comprises a second blade guard extending upwardly along a second edge of the spiral slicing insert, the second blade guard abutting the main slicing blade when the spiral slicing insert is positioned within the opening with the lower side of the spiral slicing insert extending upwardly.

Optionally, the insert includes a set of julienne blades, extending upwardly within the perimeter of the first blade guard.

The mandoline slicer may further have a ledge positioned on the frame, the ledge supporting the spiral slicing insert.

In some versions, a plate release lever is carried on the frame and is operable to cause the spiral slicing insert to be ejected from a position seated within the opening.

Some examples include a hand guard having a circular perimeter and configured to fit within the upper circular support.

Optionally, the slicer may include a standard slicing insert, the standard slicing insert configured to fit within the opening and being devoid of blades.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
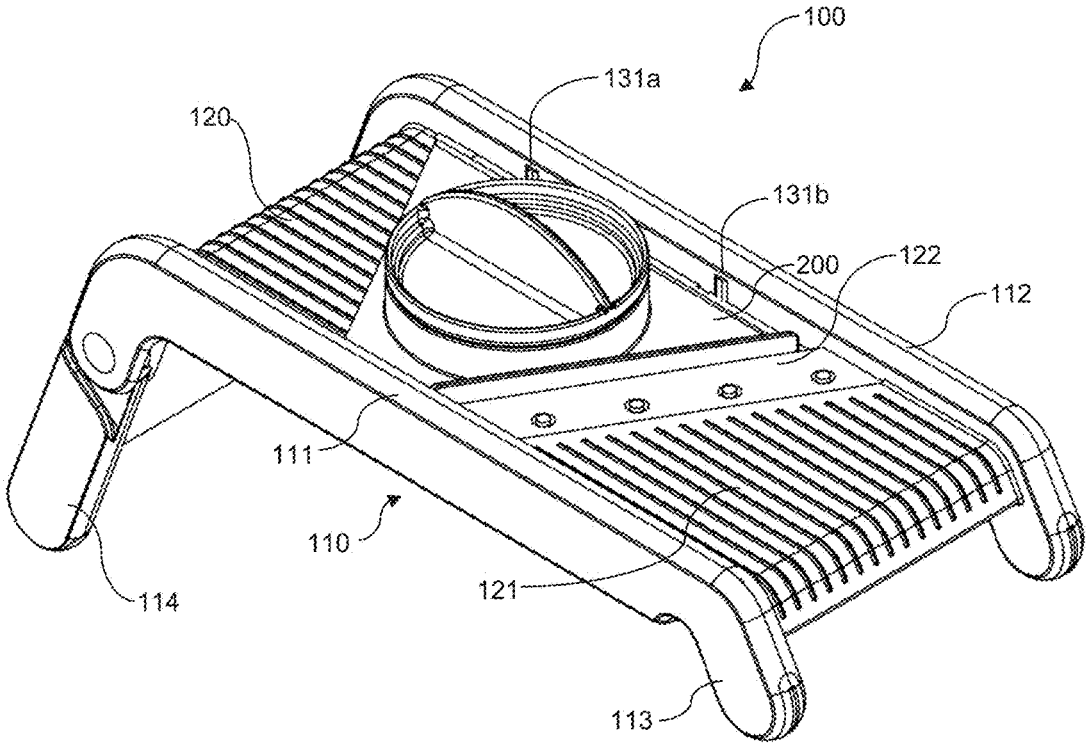
FIG. 1 is a top rear perspective view of a preferred mandoline with spiralizer insert.

As illustrated in FIG. 1, a preferred mandoline 100 includes a mandoline frame 110 and is configured to receive one or more slicing inserts. In the preferred version, the inserts include a spiralizer insert 200, transforming the mandoline from a standard slicer into a slicer for creating spiral slices. The spiralizer insert may optionally include julienne blades for cutting thin strips.

The mandoline frame includes opposing frame sidewalls 111, 112 supported by one or more legs 113, 114 which may be pivotally attached. A slicing ramp spans between the opposing sidewalls, and includes a rearward ramp portion 120 and a forward ramp portion 121 fashioned as a runout plate, such that slicing occurs only in a direction from the rearward portion toward the forward portion. An upper side of the slicing ramp faces upwardly and away from the legs, while a lower side of the slicing ramp faces downwardly in a direction toward the legs. A main slicing blade 122 spans between the frame sidewalls, with a sharpened edge facing toward the rearward ramp portion. In the illustrated example, the main slicing blade is permanently affixed to the forward ramp portion, with a sharp edge facing toward the rearward ramp portion.

Figure 4:
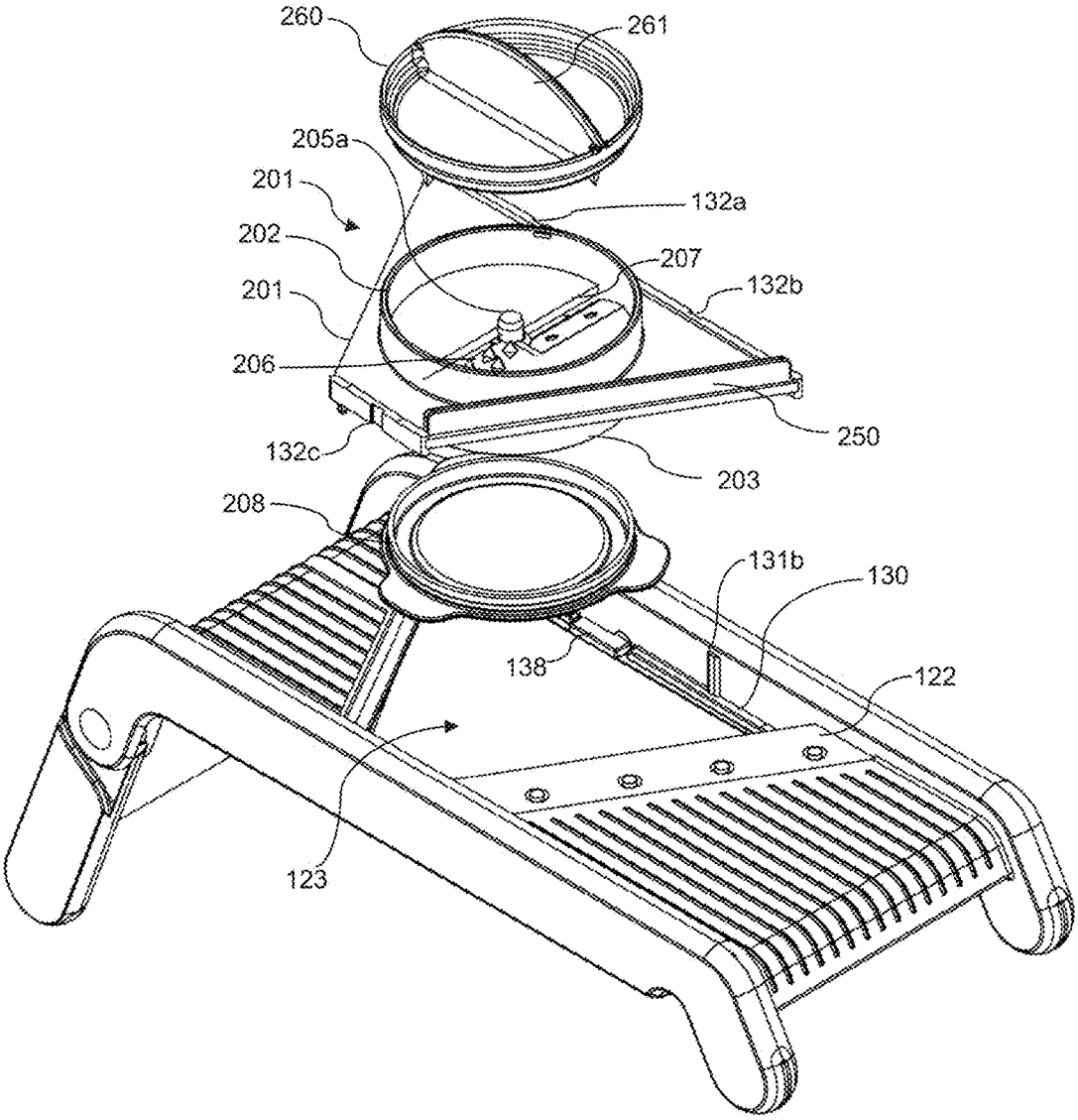
FIG. 4 is a top rear exploded perspective view of a preferred mandoline with spiralizer insert.
Figure 5:
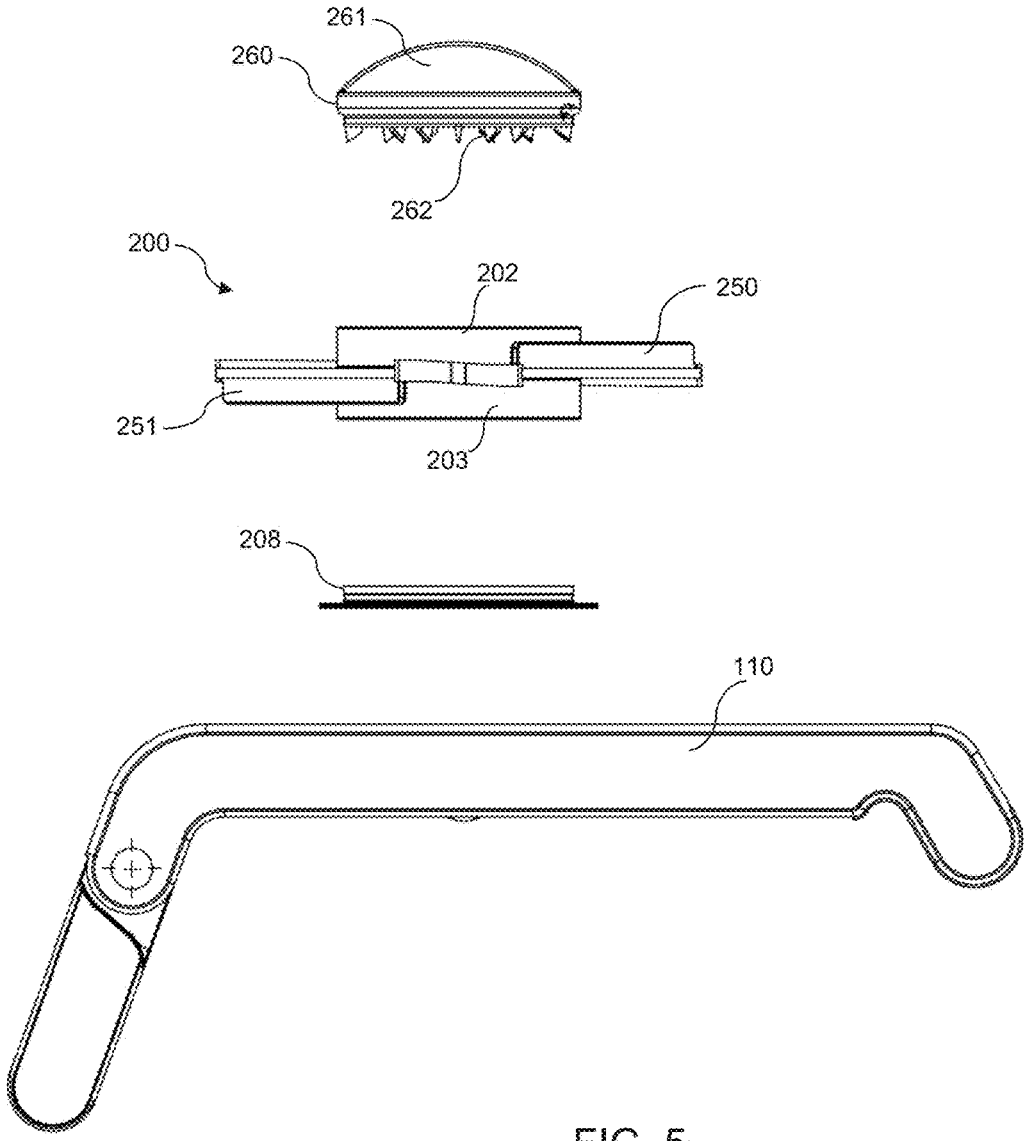
FIG. 5 is a rear exploded elevational view of a preferred mandoline with spiralizer insert.

As seen in FIG. 4, the space between the main blade and the edge of the rearward ramp portion creates an opening 123 in the ramp, the opening being triangular or trapezoidal in shape. In the illustrated version, it is trapezoidal. In other versions the opening may have yet a different shape, but is preferably formed with a perimeter that is complementary to one or more slicing inserts.

Figure 2:
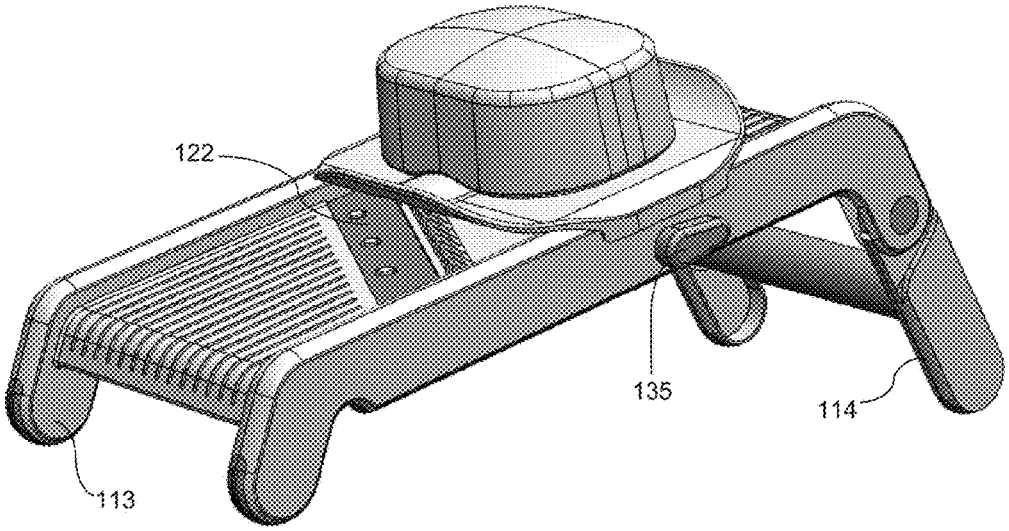
FIG. 2 is a top front perspective view of a preferred mandoline, shown with a julienne blade insert.
Figure 3:
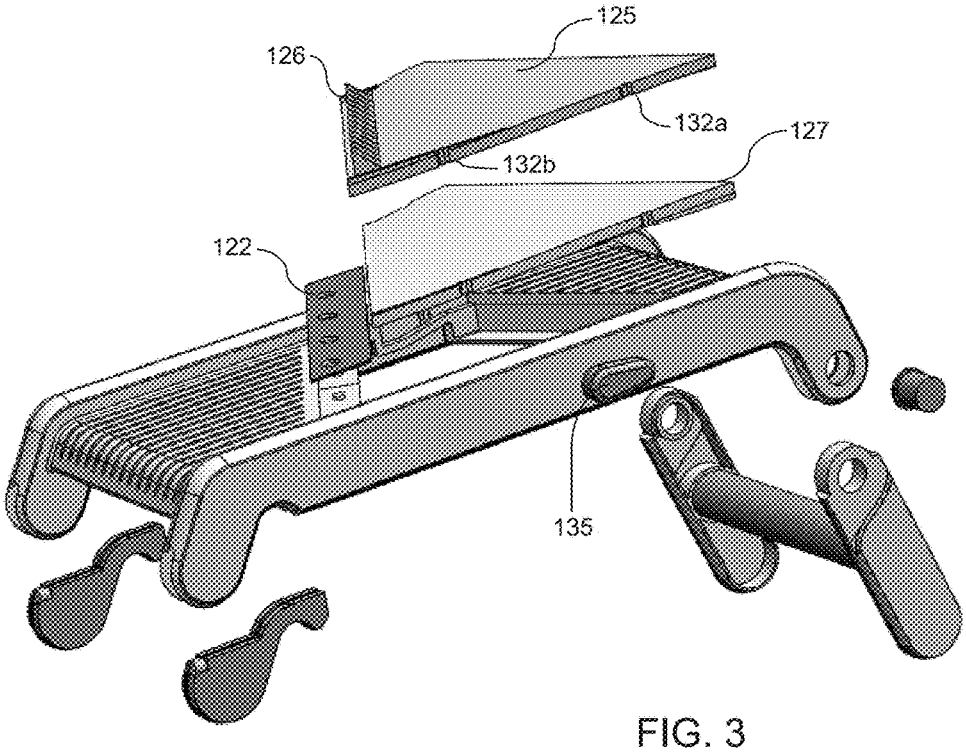
FIG. 3 is a top front perspective view of a preferred mandoline, shown with a standard slicing insert.

The ramp opening is shaped to receive any one of a plurality of slicing inserts having a mating trapezoidal perimeter to fit within the trapezoidal footprint in the ramp opening. As best seen in FIGS. 2 and 3, the slicing inserts may be configured to allow normal mandoline slicing or julienne slicing, including slicing of different thicknesses. Thus, in one version, the slicing inserts include a thick plate 125 having attached julienne blades 126, and a medium or thin standard slicing plate 127. The standard slicing plate has no blade, and most preferably it provides an extension of the rearward ramp portion to allow a food item to slide along the standard slicing plate toward the main blade for slicing. The thickness of the plate (whether the standard slicing plate or the julienne plate) can determine the thickness of a slice to be created by the mandoline, as discussed below. By selecting and inserting the desired plate with its thickness and julienne blades (or lack thereof), the user can select the type of slice to be cut by the mandoline. In a preferred version, the slicer is provided with a plurality of plates having the same footprint or perimeter but with different thicknesses to allow a user to control the slicing thickness by selecting and inserting the plate with the desired thickness.

In one version, the frame includes an inwardly directed ledge 130 on each side of the frame, along a lower portion of each frame sidewall. One or more vertical ribs 131*a*, 131*b* is also formed on each of the frame sidewalls, and the ribs mate with one or more grooves 132*a*, 132*b*, 132*c* formed in the slicing insert plates which are insertable into the open space. In one version, the inserts are friction-fit snugly into the open space, resting on the inwardly directed ledges and guided by the rib and groove arrangement.

Figure 6:
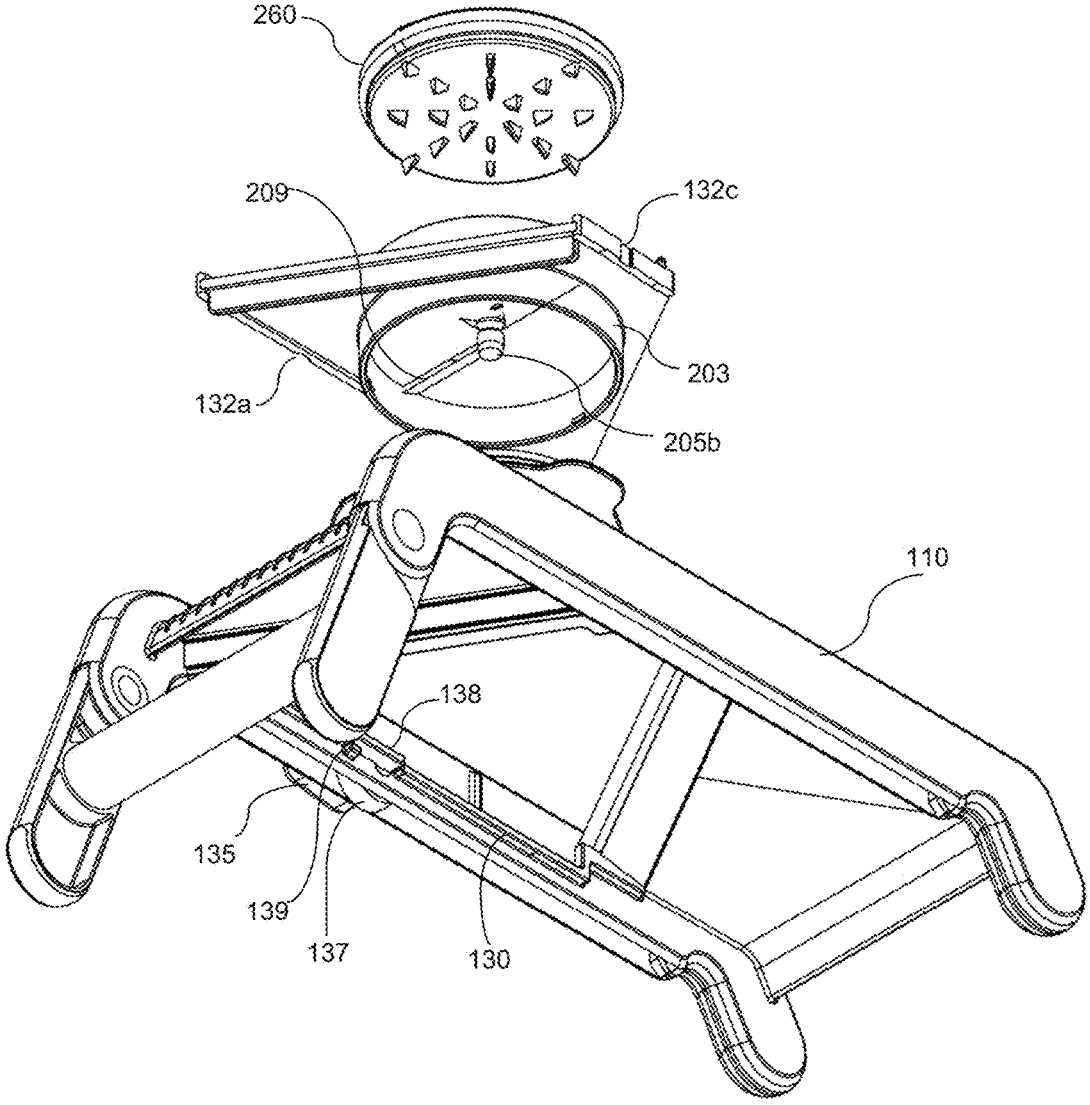
FIG. 6 is a bottom perspective view of a preferred mandoline with spiralizer insert.
Figure 7:
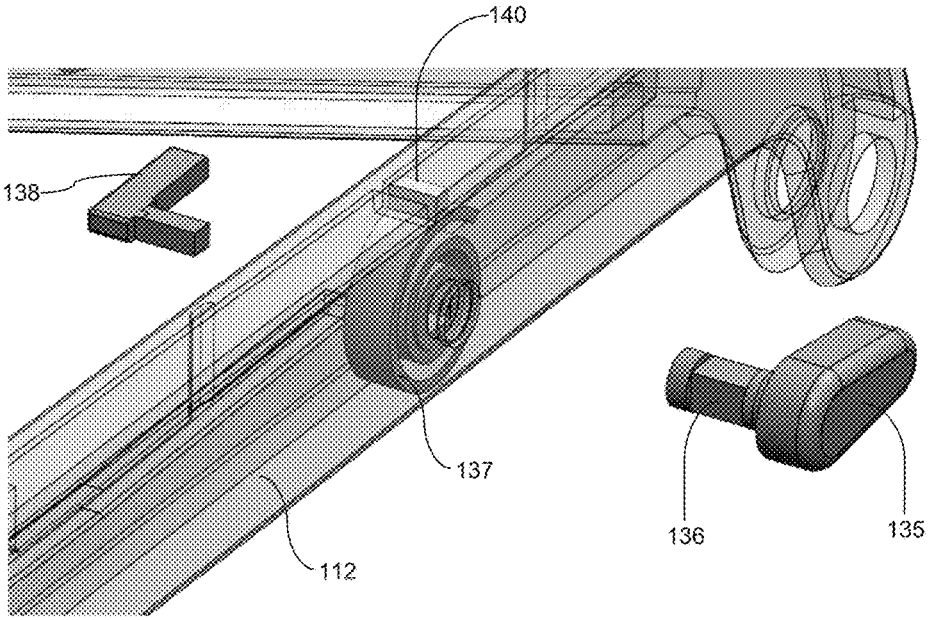
FIG. 7 is a partial cutaway view of a plate release lever for use with the preferred mandoline with spiralizer insert.

As best seen in FIGS. 6 and 7, the slicing inserts are removable via a plate release lever 135, which is pivotally mounted on an axle 136 to one of the frame sidewalls. A coiled lever spring 137 is attached at one end 140 to the frame and at the other end to the plate release lever axle, biased to urge the plate release lever in the downward position (that is, the position which allows the slicing insert plates to rest on the ledges, as described above, and in the position as illustrated in FIG. 2). A plate release lever tab 138 is attached to the distal end of the axle, on the interior space between the frame sidewalls. In the biased downward position, the tab is parallel with or below the ledges and may support the insert. When the plate release lever is rotated the tab likewise rotates, pushing the insert plate upward and allowing it to be removed. The bias of the spring will cause the lever and tab to rotate downward again upon release. A support peg 139 may be positioned on the frame, extending inwardly as with the ledges, to support the tab 138 in the downward position.

One of the slicing inserts is preferably a spiral slicing insert 200. The spiral insert includes an insert plate 201, formed with a trapezoidal shape as described above, and having a plurality of grooves 132*a*, 132*b*, 132*c* as described above. The spiralizer insert plate includes an upwardly-extending circular support 202, which serves as a guide for a pusher 260.

The spiral slicing insert further includes a downwardly extending circular support 203, extending from a lower surface of the insert plate. The downwardly extending circular support is preferably the same size and height as the upwardly extending circular support, so that in a preferred version of the invention the spiral slicing insert is invertible. But turning the plate upside down, a different spiral slicing cut is achieved.

Inside the circular support, and preferably centrally located, an alignment tube or spindle 205*a* is mounted to the insert. The alignment tube is preferably formed from stainless steel, to provide sturdy support for an object to be cut on the plate by the spiralizer. On one side of the alignment tube a set of upwardly extending julienne blades 206 is provided in the illustrated example. On the other side of the alignment tube, diametrically opposite the julienne blades, a first main spiral slicing blade 207 is provided, with an elongated opening in the slicer insert along the edge of the main blade so that food items sliced by the main blade can fall through the insert after being sliced. A cover 208 may optionally be included, configured to cover the bottom of the insert by attachment to the lower circular guard.

A first blade guard 250 extends along one edge of the spiralizer insert, projecting upwardly from the plate in a direction of the upper circular support. The blade guard is configured to be positioned closely adjacent to or abutting the sharpened edge of the main blade 122 and to thereby protect against getting cut by the main blade when the spiralizer insert is used. A second blade guard 251 is positioned at the opposite edge of the plate, extending downwardly rather than upwardly, so that when the spiralizer insert is inverted the second blade guard will be adjacent the main mandoline blade and extend upwardly.

As best seen in the bottom perspective view of FIG. 6, the preferred spiralizer insert includes a lower surface having a different cutting feature. In the illustrated example, as described above, the lower surface includes the downwardly extending circular support and a downwardly extending portion of the spindle 205*b*. A second main spiral slicing blade 209 is provided on the lower side of the spiral insert, and in this case no julienne blades are provided.

The pusher includes an upper handle 261 and a lower surface opposite the upper handle, configured with a number of spikes 262 for gripping the food item. The pusher includes a circular outer perimeter when viewed from the top, and is sized to fit within the upper circular support to enclose the blade for storage.

In use, a user selects a desired slicing insert, which may be the spiralizer insert. The plate release lever is activated if necessary to remove a slicing insert plate to allow it to be replaced with the desired plate, such as the spiralizer. In the case of an invertible spiral slicing insert as described above, the user chooses which side to face upward and which side to face downward in order to select the desired spiral slicing operation. When in position between the mandoline frame sidewalls, the bottom cover and upper pusher are removed. A food item is mounted on the alignment tube or spindle so that the food item is centered on the tube. The spikes of the pusher are then attached to the top of the food item, so that the user may rotate the handle to cause rotation of the food item on the insert. As the food item rotates, it will be cut into strips by the julienne blades and then cut by the main blade, with the strips falling through beneath the insert.

Alternate slicing inserts may not include julienne blades, so that wider ribbons may be spiral-cut.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims.

I claim:

1. A mandoline slicer, comprising:

a frame having a pair of opposing frame sidewalls;

a slicing ramp having a rearward ramp portion positioned between the opposing frame sidewalls and a forward ramp portion positioned between the opposing frame sidewalls, the forward ramp portion having a main slicing blade with a sharp edge facing toward the rearward ramp portion, the rearward ramp portion being spaced apart from the forward ramp portion to define an opening between the rearward ramp opening and the forward ramp opening; and a spiral slicing insert removably seated within the opening, the spiral slicing insert having an upper side and a lower side;

the upper side of the spiral slicing insert having an upper circular support, an upwardly extending spindle, and a first spiral slicing blade positioned inside the upper circular support; and the lower side of the spiral slicing insert having a lower circular support, a downwardly extending spindle, and a second spiral slicing blade positioned inside the upper circular support;

the spiral slicing insert further being selectively positionable within the opening such that either the upper side of the spiral slicing insert extends upwardly away from the slicing ramp or the lower side of the spiral slicing insert extends upwardly away from the slicing ramp.

2. The mandoline slicer of claim 1, wherein the spiral slicing insert further comprises a first blade guard extending upwardly along a first edge of the spiral slicing insert, the first blade guard abutting the main slicing blade when the spiral slicing insert is positioned within the opening with the upper side of the spiral slicing insert extending upwardly.

3. The mandoline slicer of claim 2, wherein the spiral slicing insert further comprises a second blade guard extending upwardly along a second edge of the spiral slicing insert, the second blade guard abutting the main slicing blade when the spiral slicing insert is positioned within the opening with the lower side of the spiral slicing insert extending upwardly.

4. The mandoline slicer of claim 3, further comprising a set of julienne blades on the spiral sliding insert and extending upwardly within the perimeter of the first blade guard.

5. The mandoline slicer of claim 1, further comprising a ledge positioned on the frame, the ledge supporting the spiral slicing insert.

6. The mandoline slicer of claim 5, further comprising a plate release lever carried on the frame and operable to cause the spiral slicing insert to be ejected from a position seated within the opening.

7. The mandoline slicer of claim 1, further comprising a hand guard having a circular perimeter and configured to fit within the upper circular support.

8. The mandoline slicer of claim 1, further comprising a standard slicing insert, the standard slicing insert configured to fit within the opening and being devoid of blades.

9. A mandoline slicer, comprising:

a frame having a pair of opposing frame sidewalls;

a slicing ramp having a rearward ramp portion positioned between the opposing frame sidewalls and a forward ramp portion positioned between the opposing frame sidewalls, the forward ramp portion having a main slicing blade with a sharp edge facing toward the rearward ramp portion, the rearward ramp portion being spaced apart from the forward ramp portion to define an opening between the rearward ramp opening and the forward ramp opening; and a spiral slicing insert removably seated within the opening, the spiral slicing insert having an upper side and a lower side;

the upper side of the spiral slicing insert having an upper circular support, an upwardly extending spindle, and a first spiral slicing blade positioned inside the upper circular support; and a first blade guard extending upwardly along a first edge of the spiral slicing insert, the first blade guard abutting the main slicing blade when the spiral slicing insert is positioned within the opening with the upper side of the spiral slicing insert extending upwardly.

10. The mandoline slicer of claim 9, further comprising a set of julienne blades on the spiral sliding insert and extending upwardly within the perimeter of the first blade guard.

11. The mandoline slicer of claim 10, further comprising a ledge positioned on the frame, the ledge supporting the spiral slicing insert.

12. The mandoline slicer of claim 11, further comprising a plurality of ribs positioned on the frame and a plurality of grooves formed in the spiral slicing insert, the ribs being received within the grooves when the spiral slicing insert is seated within the opening.

13. The mandoline slicer of claim 9, further comprising a plate release lever carried on the frame and operable to cause the spiral slicing insert to be ejected from a position seated within the opening.

14. The mandoline slicer of claim 9, further comprising a hand guard having a circular perimeter and configured to fit within the upper circular support.

15. The mandoline slicer of claim 9, further comprising a standard slicing insert, the standard slicing insert configured to fit within the opening and being devoid of blades.

* * * * *